US009488428B2

(12) United States Patent
Olivias, Jr.

(10) Patent No.: US 9,488,428 B2
(45) Date of Patent: Nov. 8, 2016

(54) SECONDARY SAFETY

(71) Applicant: Daniel Steven Olivas, Chandler, AZ (US)

(72) Inventor: Arthur R. Olivias, Jr., Tucson, AZ (US)

(73) Assignee: Daniel Steven Olivas, Chandler, AZ (US)

( * ) Notice: Subject to any disclaimer, the term of this patent is extended or adjusted under 35 U.S.C. 154(b) by 0 days.

(21) Appl. No.: 14/753,316

(22) Filed: Jun. 29, 2015

(65) Prior Publication Data

US 2016/0202009 A1 Jul. 14, 2016

Related U.S. Application Data

(60) Provisional application No. 62/101,667, filed on Jan. 9, 2015.

(51) Int. Cl.
*F41A 17/22* (2006.01)
*F41A 17/46* (2006.01)

(52) U.S. Cl.
CPC ..... *F41A 17/22* (2013.01); *F41A 17/46* (2013.01)

(58) Field of Classification Search
CPC ..... F41A 17/22; F41A 17/46
USPC ..... 42/70.06, 70.07, 70.11, 70.01
See application file for complete search history.

(56) References Cited

U.S. PATENT DOCUMENTS 1,593,981 A * 7/1926 McCrudden ..... F41A 17/20 42/69.01
2,335,669 A * 11/1943 Hanson ..... F41A 17/20 42/70.06
2,525,886 A * 10/1950 Fraser ..... F41A 17/20 42/70.03
2,607,148 A * 8/1952 Simpson ..... F41A 19/09 42/69.01
2,635,380 A * 4/1953 Baker ..... F41A 17/22 42/70.06
3,141,254 A * 7/1964 Savioli ..... F41A 19/09 42/70.06
3,715,826 A * 2/1973 Seifried ..... F41A 17/36 42/6
4,300,301 A * 11/1981 Morrison ..... F41A 17/46 42/70.06
5,025,582 A * 6/1991 Mote, Sr. ..... F41A 35/06 42/70.06
5,678,342 A * 10/1997 Felk ..... F41A 19/35 42/69.02
6,415,539 B1 * 7/2002 Fuchs ..... F41A 17/46 42/70.01
6,499,243 B1 * 12/2002 Herzog ..... F41A 17/066 42/70.06
2002/0014030 A1 * 2/2002 Parker ..... F41A 17/04 42/70.07
2009/0158634 A1 * 6/2009 Bubits ..... F41A 17/46 42/70.06

* cited by examiner

*Primary Examiner* — Reginald Tillman, Jr.

(74) *Attorney, Agent, or Firm* — Yakov Sidorin; Quarles & Brady LLP

(57) ABSTRACT

Secondary safety for firearm and method for automatic locking firearm's trigger even with disengaged primary safety. The mechanism includes a rigid bar and a spring unit biasing the rigid bar against the firearm's body to transfer vectored force to the back of the trigger against the trigger's movement, and is cooperated with firearms using existing firearm's components. Secondary safety blocks trigger immediately each time the user's finger is taken off the trigger and can be disengaged only with user's input directed against the vectored force and increasing it.

12 Claims, 10 Drawing Sheets

SECONDARY SAFETY

CROSS-REFERENCE TO RELATED APPLICATIONS

The present application claims benefit of and priority from the U.S. provisional patent application No. 62/101,667, filed on Jan. 9, 2015. The disclosure of this provisional application is incorporated herein by reference in its entirety.

TECHNICAL FIELD

The present invention relates to a system and method for improving gun safety and, in particular, to a secondary safety feature preventing accidental or negligent discharge of a firearm.

BACKGROUND

Accidental discharge is the event of a firearm firing (discharging) at a time not intended by the user. Perhaps most commonly, accidental discharges (sometimes called ADs by military and police personnel and sometimes referred to as negligent discharges) occur when the trigger of the firearm is deliberately pulled for a purpose other than shooting (such as demonstration, function testing, or dry-fire practice, for example) while ammunition is present in the chamber. Another, second common cause of accidental discharges occurs when the gun-handler places his finger on the trigger before he has decided to shoot. With the finger being so positioned, many events may cause the finger to compress the trigger unintentionally. For example, if one attempts to holster the firearm with his finger on trigger, the holster edge will drive the finger onto the trigger, causing a likely discharge. If one stumbles or struggles (with an adversary) with his finger on the trigger, the grasping motion of both hands will likely cause the trigger finger to press the trigger.

On occasion, an accidental discharge can occur for a reason other than the finger pulling the trigger, such as dropping a loaded weapon (whether or not secured around the torso of the user with a sling). Because of this possibility, most of the recently produced pistols are designed with a "drop-safety" or firing pin block, a mechanism inhibiting or isolating the firing pin, preventing accidental discharge if the firearm is dropped. However, most long guns do not have drop-safety features. Another common incidence of accidental discharge of the firearm (in particular, assault rifles) occurs when the user lets the rifle go and, before the rifle hangs on a sling over the user's torso, the rifle rubs against the torso and the items of user's clothing on its way to the hanging position. Any item protruding from the clothing of the user can and often does depress the trigger upon interaction with the dropped firearm. While gun safety rules recognize these possibilities and aim to prevent them, it is the tangible safety features—such as, for example, a trigger lock (an example 110 of which is shown in FIG. 1A, depicting a firearm 112) and a mechanism often called a "safety" (such as an external safety lever or latch on the side of the firearm or a grip safety mechanism of a handgun, an example 120 of which is shown in FIG. 1B, depicting a portion 122 of a firearm)—that are relied on to prevent an accidental discharge.

However, in the heat of the moment or just because of the mundane inattention, the user often simply forgets to activate the firearm's external, manual safety such as the safety 120 (interchangeably referred to herein as an external safety latch, manual safety latch, primary safety, or a primary safety mechanism), thereby negating the very purpose of the primary safety.

As far as a trigger lock mechanism is concerned, generally, two pieces come together from either side behind the trigger and are locked in place to form a lock that is substantially immovable and not repositionable unless unlocked with a key or combination. This physically prevents the trigger from being pulled to discharge the weapon. Other types of trigger locks do not go behind the trigger, but encompass the full area behind the trigger guard making the trigger inaccessible. It is well recognized in the art, however, that trigger locks are not designed to be used on loaded guns (see, for example, discussion in "Hype Over Trigger Locks Provokes Fear of Firearm Accidents", E. Slater, Los Angeles Times, Feb. 16, 1999), which makes them basically useless for preventing negligent discharges. It is also well understood that the existing safety measures, while effective in majority of situations, occasionally may fall short of being "fool-proof" and providing a peace of mind to a responsible armed citizen.

There remains an unmet need, therefore, for a firearm safety feature that compensates for the discharge accidents that are not prevented by the primary safety mechanism

SUMMARY

Embodiments of the invention provide an article of manufacture that includes a rigid bar having first and second ends, the rigid bar having first and second portions that form a spatial bend in the rigid bar, the first end corresponding to the first portion, the second end corresponding to the second portion, the spatial bend defined in a plane. The article also includes a spring mechanism affixed to the second portion in a spatial coordination that defines, in operation of the spring mechanism, a vector of spring force in said plane. The article is configured for use as a secondary safety mechanism with a firearm.

Embodiments also provide a method for locking a trigger of a firearm with a secondary safety mechanism. The method includes a step of positioning the secondary safety mechanism between a back side of the trigger and a grip of the firearm. The secondary safety mechanism contains (i) a rigid bar having first and second ends, the rigid bar having first and second portions forming a spatial bend in the rigid bar, the first end corresponding to the first portion, the second end corresponding to the second portion, the spatial bend defined in a first plane, and (ii) a spring mechanism affixed to the second portion, between the second portion and the body, in a spatial coordination that defines a vector of spring force in said first plane. The positioning of the secondary safety mechanism is carried out such that the first plane is parallel to a second plane, the second plane defined by a plane in which the trigger moves during operation of the firearm. The method additionally includes a step of attaching the secondary safety mechanism to a body of the firearm through a hinge to form, with said secondary safety mechanism, a lever pivoting about the hinge in the first plane between first and second angular positions.

BRIEF DESCRIPTION OF THE DRAWINGS

The invention will be more fully understood by referring to the following Detailed Description in conjunction with the generally not-to-scale Drawings, of which.

DETAILED DESCRIPTION

Figure 1A:
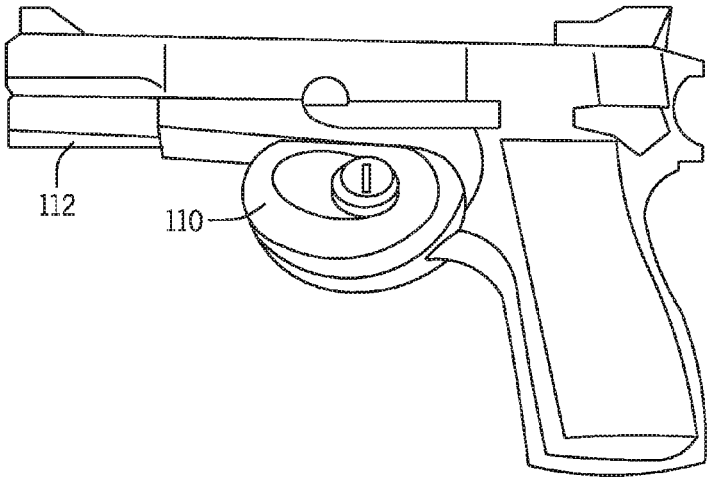
FIG. 1A (PRIOR ART)
FIGS. 1A, 1B illustrate schematically a trigger lock and a manual (primary) safety latch, respectively, conventionally used with firearms.
Figure 1B:
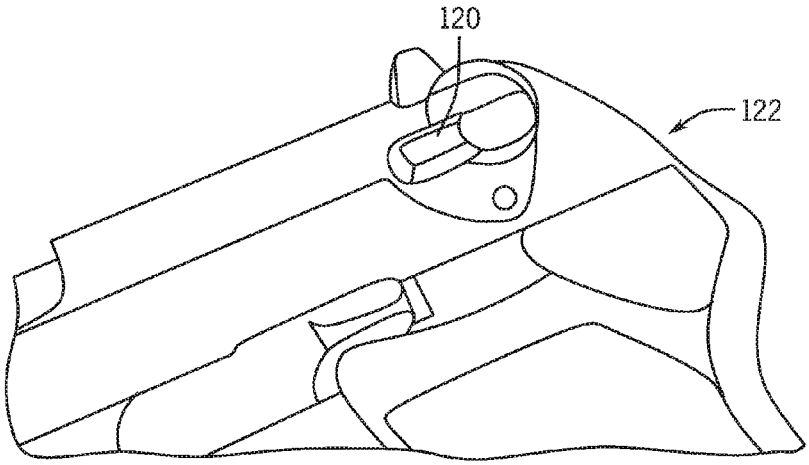
FIG. 1B (PRIOR ART)

A problem of accidental discharge of a firearm, occurring when the primary safety mechanism is left disengaged ("off", leaving the trigger unlocked) or becomes disengaged due to external circumstances, is solved by providing a secondary safety (interchangeably referred to herein as a secondary safety mechanism). The activation (and re-activation) of the secondary safety mechanism (causing the locking of the trigger by the secondary safety mechanism) is automatic, occurs independently of volition of and does not require the input from the user of the firearm. An embodiment of the invention re-activates upon release of pressure of the natural hand grip on rifle, at which time the spring system of the embodiment reengages a trigger block portion of the secondary safety mechanism to go automatically behind the trigger. At the same time, the de-activation of the secondary safety mechanism (as a result of which the secondary safety mechanism does not lock the trigger anymore) requires a conscious mechanical input from the user. Accordingly, the trigger of the firearm requires two different inputs provided by the user.

Example 1

FIGS. 2A, 2B, 2C, and 2D illustrate schematically an example 200 of an article of manufacture embodying a secondary safety mechanism according to the idea of the invention. The article 200 includes a rigid bar 202 (made, for example, of metal or material the mechanical properties of which are comparable to or exceeding that of metal, such as specific ceramics or graphite, for example) having first and second ends 204, 208. The rigid bar includes first and second portions I, II that are united, abutted to one another such as to spatially extend one another and to form a spatial bend defined in a first plane (as shown—in the xz-plane). The internal curvature of the so-bent bar defines an inner surface 210, while the outer surface of the bar is marked 214. As shown, the portions I, II are made integrally with one another (for example, in one mold and from the same material); alternatively, these portions can be fabricated separately (optionally—from different materials) and then adjoined or integrated.

Figure 2A:
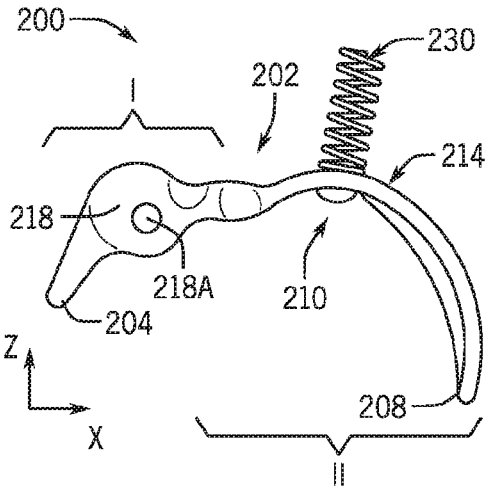
FIGS. 2A, 2B, 2C, and 2D illustrate schematically an embodiment of the secondary safety mechanism in different side views.
Figure 2B:
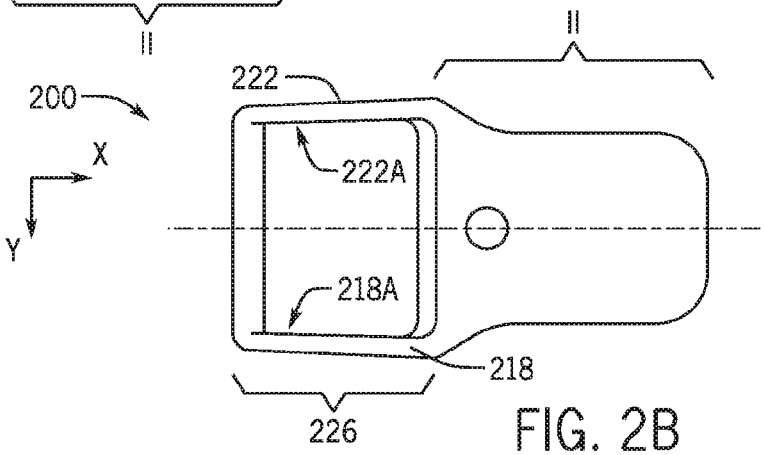
Figure 2C:
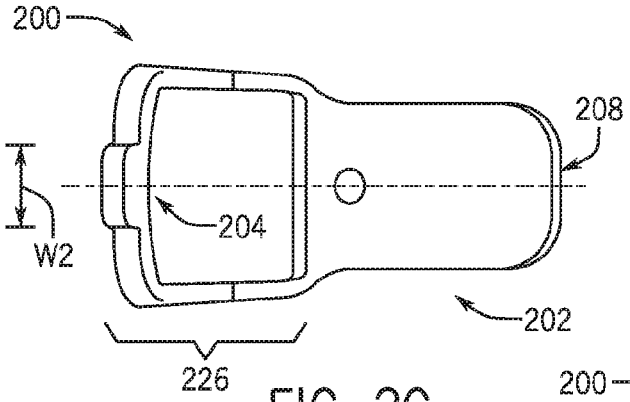

In reference to FIGS. 2B and 2C, the first portion I of the embodiment 200 includes two walls 218, 222 separated from one another along an axis (as shown—along the y-axis) that is perpendicular to the first plane. These two walls, together with the remaining sections of the portion I, form a framed opening 226 in and through the rigid bar. The purpose of such configuration, as will be discussed below, is to accommodate the trigger guard of a firearm. In the article 200, each of the walls 218, 222 (forming part of the frame around the opening) contains a corresponding aperture. These apertures 218A, 22A are coaxial with one another and configured to accommodate a pin with the use of which in one implementation, the article 200 is cooperated with the firearm. In reference to FIGS. 2C and 2D, it is appreciated that the width W1 of the frame of the opening 226 can be substantially equal to or larger than the width of the first end or prong 204. In practice it may be preferred to make the first end or prong of the article 200 approximately as wide as the trigger of the firearm with which the article is used, and the width W1 slightly wider than the trigger guard (for example, 10 to 50 percent wider). The width of the second end 208 (not marked) can be generally arbitrary, but for practical convenience it may be dimensioned somewhere between or about the values of W1 and W2. In a specific case, the rigid bar 202 can be made symmetrical with respect to the first plane (xz-plane).

Figure 2D:
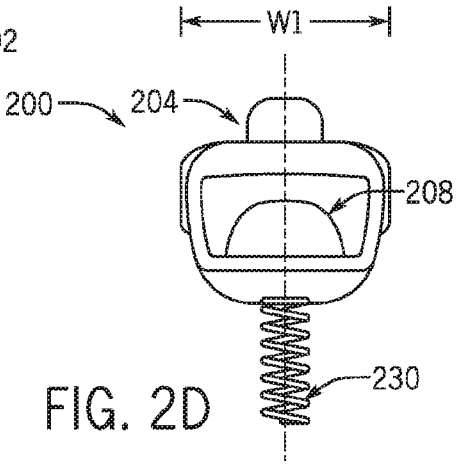

The article 200 is additionally equipped with a spring mechanism configured to generate, in operation and after the article 200 is cooperated with the firearm, a vectored force pushing the second portion II away from the body of the firearm, as discussed below. As shown in the example of FIGS. 2A through 2D, the spring mechanism includes a coil spring 230 attached to the second portion II at only one end of the spring. Provided that, in operation, the spring mechanism is configured to be abutting the body of the firearm, it may be advantageous to shape the coil spring 230 as a cone (as shown in FIG. 2D). In this case, a diameter of a coil at the second (free) end of the spring 230 is bigger than that of a coil at the end that is affixed to the second portion II, and a surface tangential to the loops of the soil spring 230 is a conical surface. Such configuration is beneficial in that it increases the area of contact between the spring mechanism of the article 200 and the body of the firearm, in operation. Generally, a spring mechanism used in an embodiment of the present invention includes a combination of multiple and, optionally, different type springs, or a combination of at least one spring and a component biased against and moveable by such spring. In related embodiments, for example, the spring mechanism may include different contraptions such as, for example, a leaf spring configured as a cantilever spring (that is fixed to the second portion II at only one end), or a combination of a torsion spring with the spring base (as discussed below).

Example 2

Figure 2E:
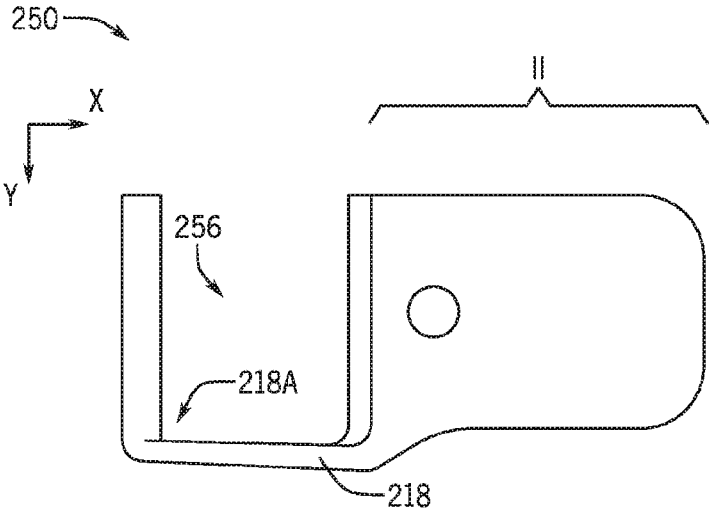
FIG. 2E illustrates, in top view, a related embodiment of the secondary safety mechanism.

It is appreciated that a particularly shaped perimeter of the article 200, illustrated in FIGS. 2A, 2B, 2C, and 2D is not required for proper operation of the article 200. For example, in a related asymmetric embodiment 250 (which is the modified embodiment 200), schematically shown in top view in FIG. 2E, the wall 222 (of the frame defining the opening 226 of embodiment 200) is not present. As a result, the opening 256, which accommodates in operation the trigger guard of the firearm, is walled at only three sides. Such configuration may be of interest in some circumstances as it may simplify the installation of the secondary safety element onto the firearm.

Example 3

Figure 3:
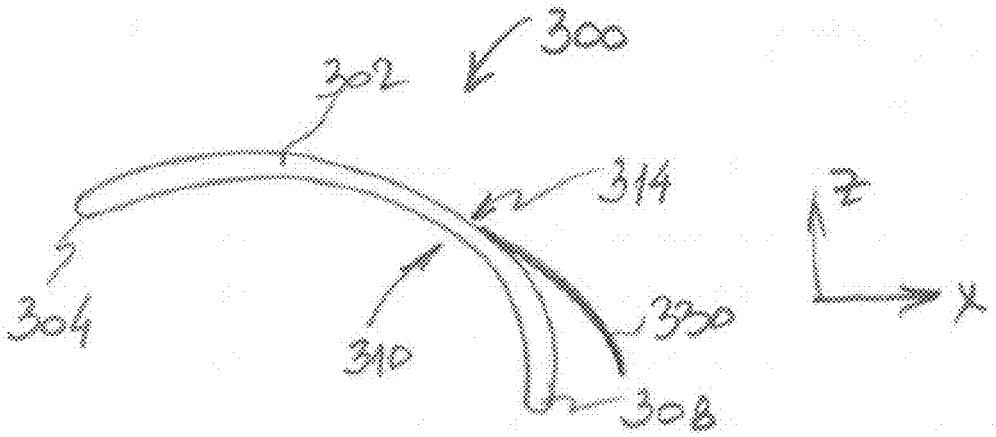
FIG. 3 illustrates, in side view, another related embodiment of the secondary safety mechanism.

In another related embodiment 300 (shown schematically in side view in FIG. 3) that has the first and second ends 304, 308, the rigid bar 302 of the article 300 may be formed from the first and second portions joined such as to define inner and outer surfaces 310, 314 the radii of curvatures of which are monotonically changing. The side view of FIG. 3 corresponds to the side view of FIG. 2A (the remaining views of the embodiment 300 being similar to those of FIGS. 2B, 2C, and 2D). As shown, the embodiment 300 is equipped with a spring mechanism including a leaf cantilever spring 330.

Example 4

Figure 4:
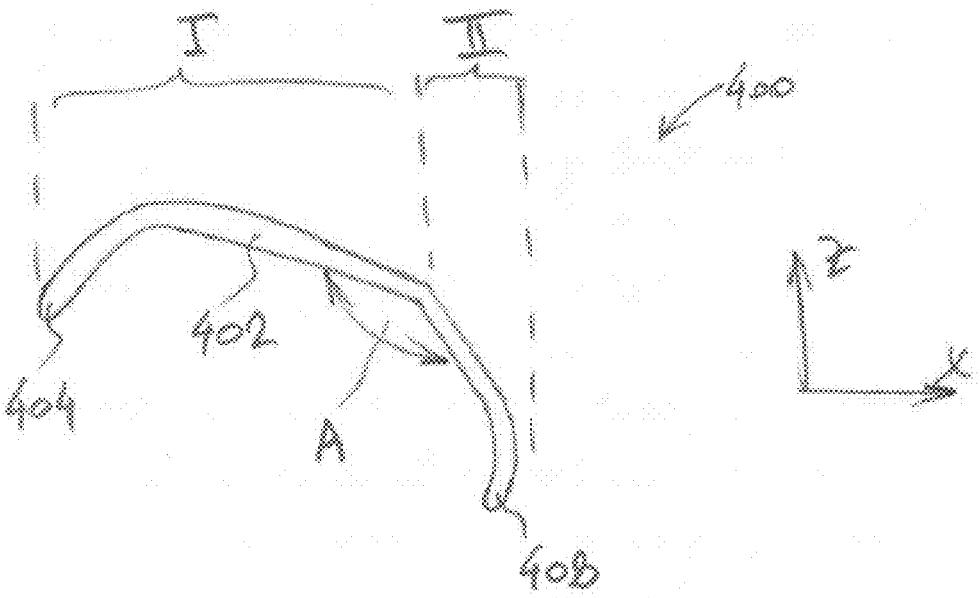
FIG. 4 illustrates, in side view, yet another related embodiment of the secondary safety mechanism.

In another related embodiment, shown as 400 in FIG. 4, the portions I, II are configured to contain straight regions such as to form, when the portions I, II are united, not only the bent of the rigid bar 402 in the xz-plane, but also a dihedral angle A in the same plane in which the bent of the bar 402 is defined. The embodiment 400 is shown for simplicity of illustration without a spring mechanism.

Figure 8A:
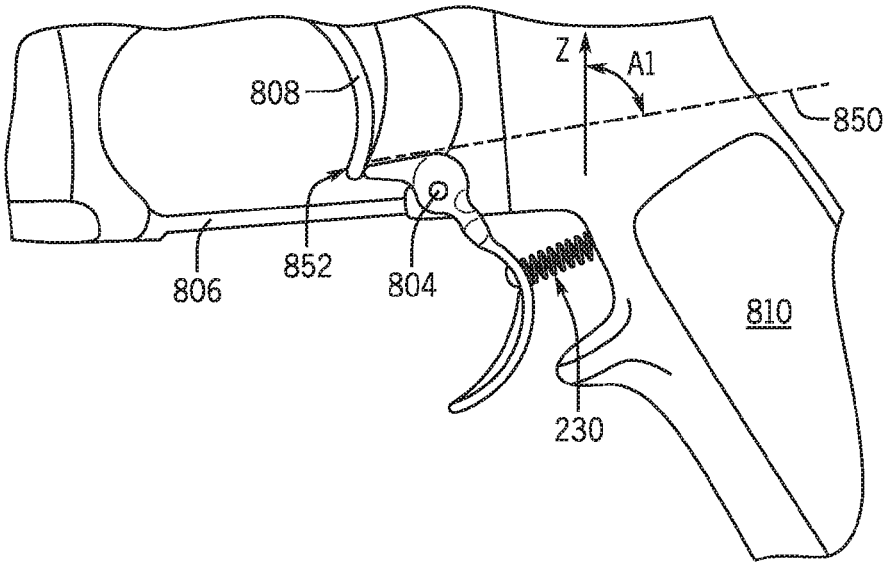
FIG. 8A illustrates operable cooperation between the embodiment of the secondary safety of FIG. 2A and the firearm in the first angular position of the embodiment, in which the spring mechanism is in contact with the body of the firearm and exerts a first vectored force on the secondary safety, the first end of the secondary safety abuts against a back side of the trigger, and a position of the trigger is locked by such abutting due to the first vectored spring force transferred to the back side of the trigger through the secondary safety.
Figure 8B:
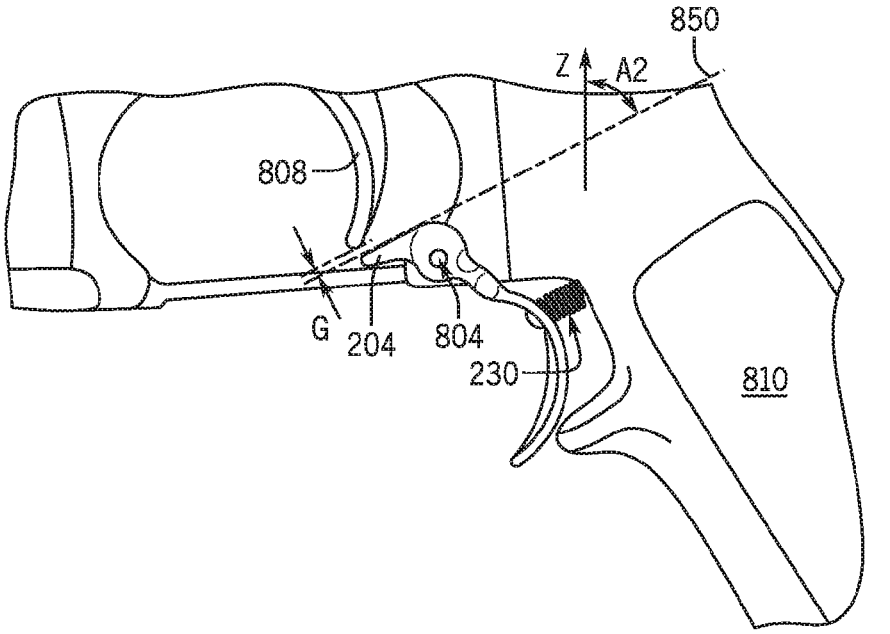
FIG. 8B illustrates operable cooperation between the embodiment of the secondary safety of FIG. 2A and the firearm in the second angular position of the embodiment, in which the spring mechanism is in contact with the body of the firearm and exerts a second vectored spring force on the secondary safety, the first end of the secondary safety is separated from the trigger to define a spatial gap between a tip of the trigger and the secondary safety, and the trigger is released to move from the position in which it was locked as shown in FIG. 8A.

In operation, embodiments of the secondary safety that were discussed above and similar embodiments are cooperated with a particular firearm such as to form a lever (i) that is configured to be pivoted about a point or an axis by a force applied by a finger of the user of the firearm to portion II of the embodiment of the secondary safety and (ii) that, as a result of such pivoting, locks a trigger of the firearm in an off position. While details of the installation of an embodiment of the secondary safety mechanism on the firearm can differ, the principle of the spatial cooperation between the embodiment and the firearm will be readily understood in reference to FIGS. 8A and 8B. FIGS. 8A, 8B illustrate the installation of the embodiment of FIG. 2A on a pin 804 of the guard 806 of the trigger 808 of the firearm 810. In one case, the pin 804 is temporarily removed from the trigger guard 806, and a plank of the guard 806 is tilted to open the guard 806 and to set the embodiment 200 onto the plank such that the plank passes through the opening 226. Afterwards, the plank of the guard 806 is closed, and the pin 804 is re-installed in its original position—this time, both through the openings 218A (and 222A, if present) of the embodiment 200 and the pin-openings of the guard 806. Such installation structurally results in a lever, formed by the embodiment 200, that is biased with the spring mechanism (in this case—the coil spring 230) against the body of the firearm 850 and that is configured to operate by pivoting the embodiment 200 about the pin 804. In operation, the pivoting of the secondary safety occurs between two different angular position, which are illustrated respectively in FIGS. 8A and 8B.

As shown in FIG. 8A, in the first angular position of the secondary safety mechanism (denoted by an angle A1 formed between a line 850, which is tangential to the outer surface of the first portion of the embodiment 200 at a chosen point of its first end 204, and the z-axis in the xz-plane), the end of the spring mechanism 230 that is not affixed to the embodiment 200 is in contact with the body of the firearm 850. At the same time, the first end 204 of the embodiment 200 is abutted (touches at the surface) against the back side of the trigger 808 at a point that is sufficiently distanced from the tip 852 of the trigger. The embodiment 200 and its spring mechanism are judiciously dimensioned, depending on the specific geometry of the firearm 810, to ensure that in the configuration of FIG. 8A the spring mechanism is biased to exert a first vectored force onto the embodiment 200 such as to press the first end 204 against the back side of the trigger 806 to fix and lock the trigger 806 in the "off", not depressed position.

Changing the mutual positioning of the elements shown in FIG. 8A—that is, unlocking the trigger 806—requires the use to take a complex action that includes pivoting the embodiment 200 about the pin 804. Specifically, the user has to press the second portion II of the embodiment at the inner surface 210 towards the body 850 (as shown—towards the grip of the firearm 810) such as to compress (or, in a different implementation, create a torsion in) the spring mechanism while the first end 204 slides along and under the trigger 808 towards the trigger guard 806, such as create, at the second angular position of the embodiment 200, a gap G between the trigger 808 and the embodiment 200. The spatial cooperation between the firearm 810 and the embodiment 200 in the second angular position is shown in FIG. 8B, where the angle A2 formed by the z-axis and the line 850 is different from A1 and where the kinetic energy, stored in the spring mechanism as a result of the pressure on the second portion II by the user's finger, is illustrated by a shortened length of the coil spring 230 as compared to that of FIG. 8A. Once the secondary safety mechanism is in such second angular position, the trigger 808 is free to move from its locked-by-the-secondary-safety-mechanism position (of FIG. 8A) and can be depressed by the user to discharge the firearm 810.

Example 5

Figure 5A:
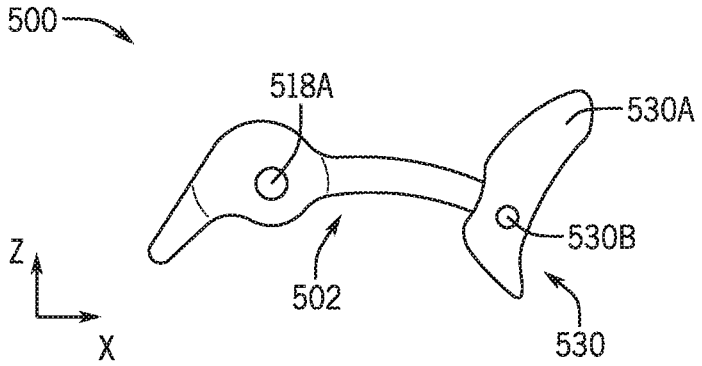
FIGS. 5A, 5B are schematic illustrations of the assembled embodiment of FIGS. 6A, 6B, 6C.
Figure 5B:
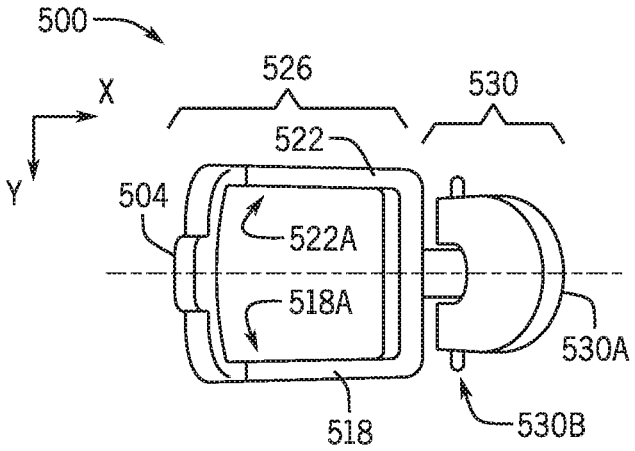
Figure 6B:
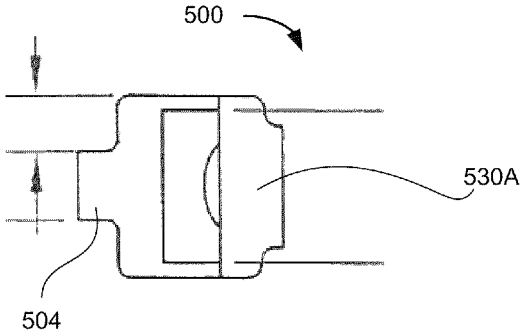
FIGS. 6A, 6B, 6C provide different views of the alternative embodiment that is assembled from the constituent components of FIGS. 7A, 7B, 7C, 7D, and 7E.
Figure 6A:
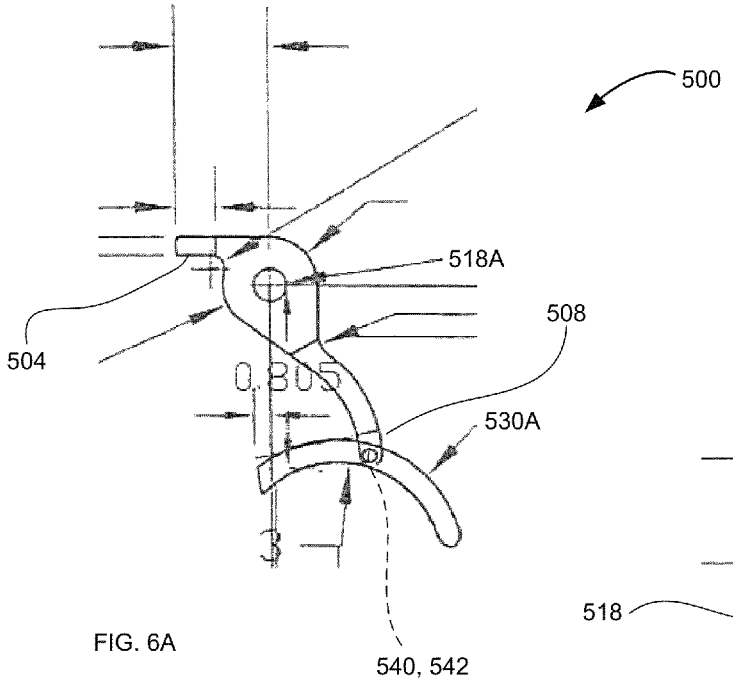
Figure 6C:
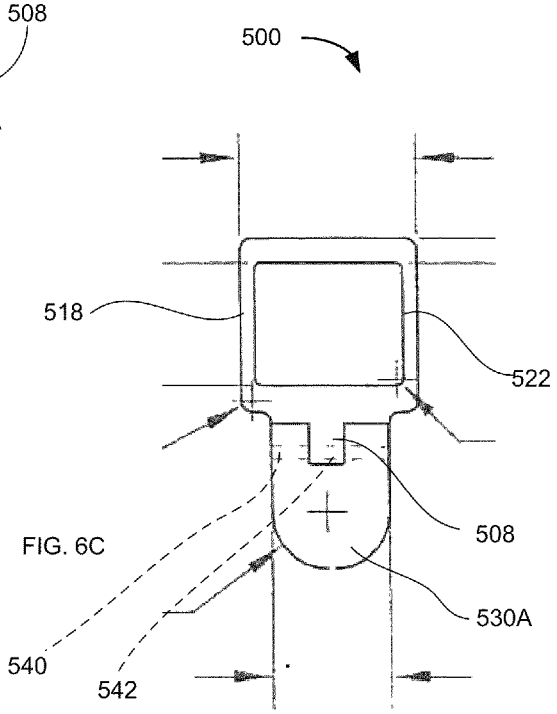
Figure 7B:
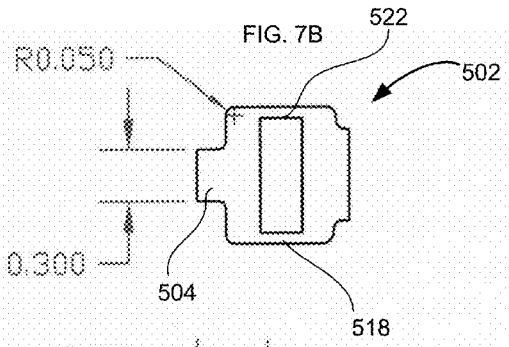
FIGS. 7A, 7B, 7C, 7D, 7E provide different views of constituent components of an alternative embodiment of the secondary safety mechanism.
Figure 7E:
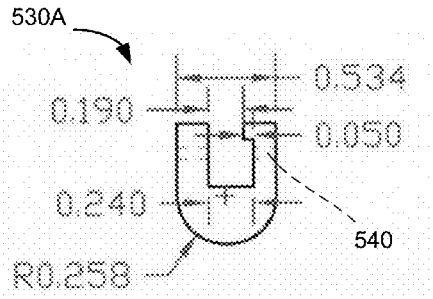
Figure 7A:
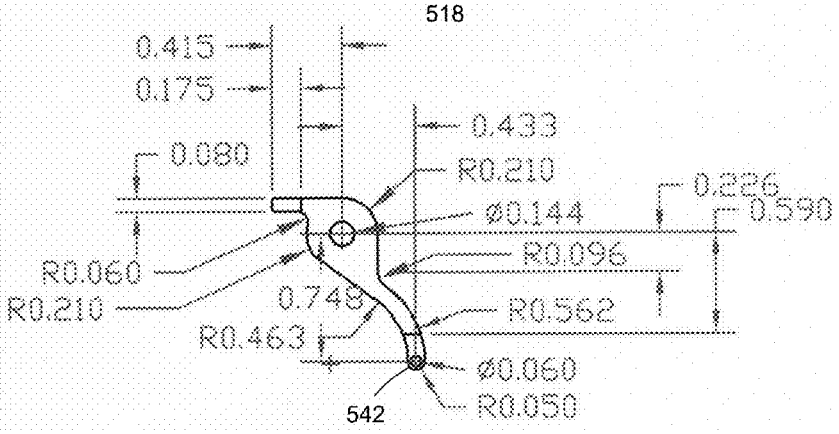
Figure 7C:
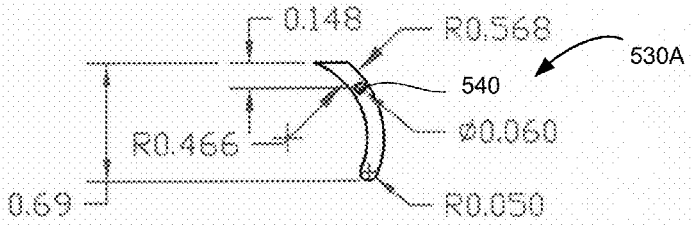
Figure 7D:
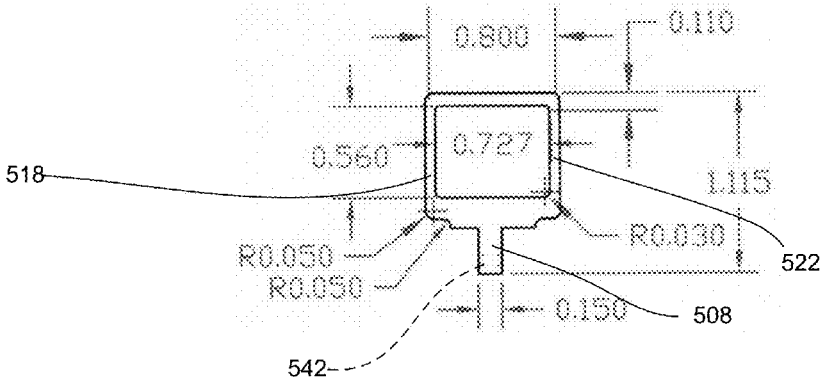

Another related embodiment 500 of the secondary safety mechanism is illustrated in FIGS. 5A and 5B and, in different views in FIGS. 6A, 6B, 6C. FIGS. 7A, 7B, 7C, 7D, and 7E illustrate some of the individual components of the mechanism 500 with examples of dimensions.

The embodiment 500 includes a rigid bar 502 and a spring mechanism 530 moveably cooperated with the rigid bar 502. The bar 502 is structured by analogy with the rigid bar 202 of the embodiment 200, in that it includes the first end or prong 504, the second end 508, the opening 526 framed in part by the walls 518, 522, and the co-axial apertures 518A, 522A in the walls 518, 522. The apertures 518A, 522A are dimensioned to accommodate a pin of the trigger guard of a particular firearm with which the embodiment 500 is intended to be used.

The spring mechanism 530 of this related embodiment, however, contains two portions: a spring base 530A (which has a shape reciprocal to the shape of the second end 508 to facilitate the mechanical mating between the two), and the torsion spring element 530B. The torsion spring element 530B includes, in turn, a torsion spring (not shown) set on a pin that simultaneously connects the spring base 530A and the second end 508 through the co-axially aligned cylindrical openings 540, 542. The openings 540, 542 are made in the spring base 530A and the second end 508, respectively. As shown, the spring base 530A includes two protrusions (each having a throughout opening 540) configured to "sandwich" the second end 508 therebetween when attached to the second end with the use of the torsion spring element 530A. It is appreciated that in a related implementation, the situation may be reversed: the spring base 530A can have only one protrusion that is fitted between the portions of the second end 508, shaped like a dove-tail.

When assembled and cooperated with a firearm, the embodiment 500 is hingedly set on a pin of a trigger guard through the openings 518A, 522A (as discussed for the embodiment 200 in reference to FIGS. 8A and 8B), while the spring base 530B is constantly kept in contact with a grip of the firearm due to the force-bias created by the torsion spring. When the embodiment 500 is in a first angular position (similar to that shown in FIG. 8A), the torsion force formed by the torsion spring is larger than that corresponding to the second angular position.

It is understood, therefore, that the (re-)activation of the secondary safety mechanism such as the mechanisms 200, 500, for example, causes locking of the trigger of the firearm and occurs automatically, due to the spring bias, each time when the finger of the user is removed from the trigger of the firearm, without any additional action from the user. An embodiment of the invention is configured to re-activate upon release of pressure of the natural hand grip on rifle, at which time the spring system or mechanism of the embodiment reengages a trigger block portion of the secondary safety to go automatically behind the trigger. In other words, even when the primary safety of the firearm is de-activated, the trigger will be locked (as shown in the example of FIG. 8A) with the embodiment of the invention positioned in the first angular position. On the contrary, the de-activation of the secondary safety mechanism (as a result of which the trigger is no longer locked with the secondary safety mechanism) does not happen by occurrence as it requires a conscious effort and input on the part of the user to bring the mechanism from the first angular position to the second angular position (as shown in the example of FIG. 8B). The secondary safety mechanism can be kept de-activated as long as required by simply keeping it depressed (in the second angular position) with a finger. Notably, the use of the secondary safety according to the invention does not require any additional training on the part of the user.

Example 6

Figure 9A:
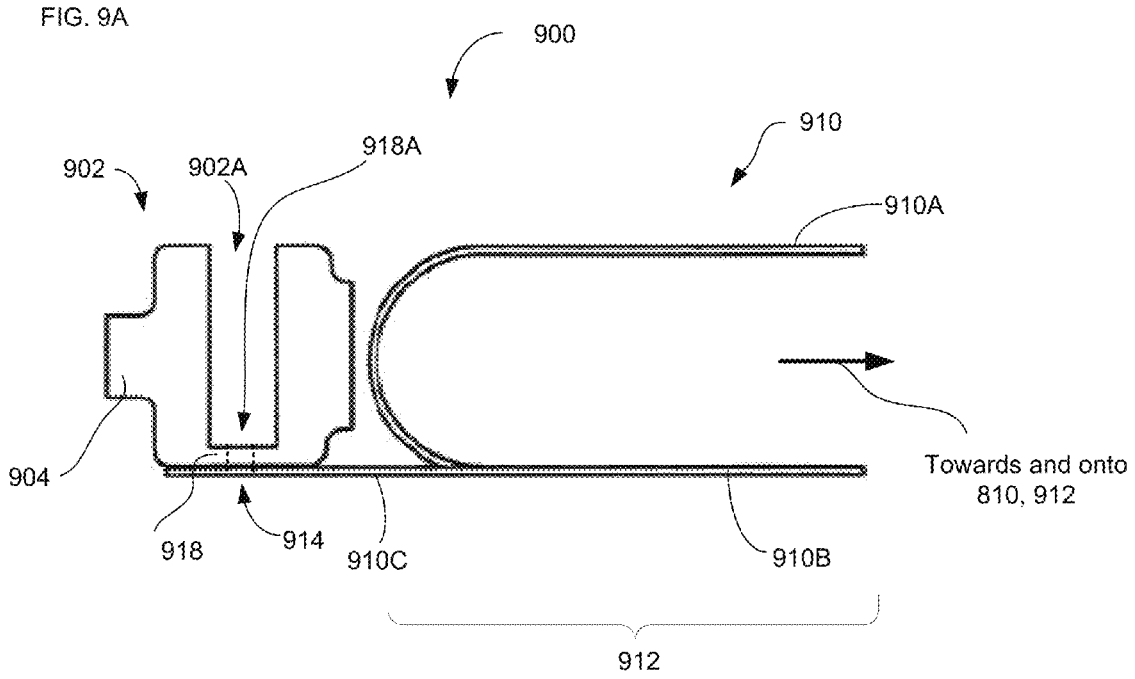
FIG. 9A is a top view of a related embodiment of the secondary safety configured to be attached to and detached from the firearm without a need to remove a trigger-guard pin.
Figure 9B:
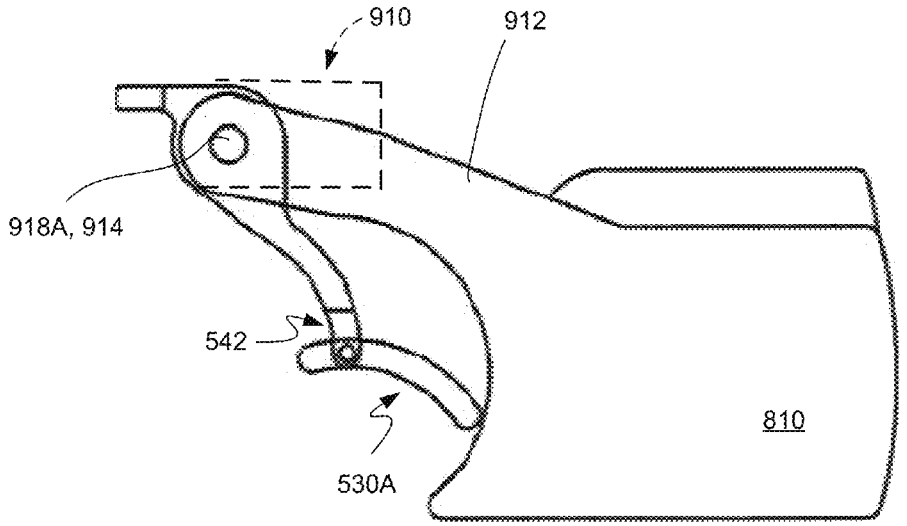
FIG. 9B is a schematic diagram showing, in side view, the cooperation of the embodiment of FIG. 9A with a firearm.

Yet another related implementation 900 of the invention is illustrated in the views of FIGS. 9A, 9B. The cooperation of this embodiment with a firearm does not require a removal of the guard pin of the firearm, while its configuration facilitates the addition and removal of the embodiment to and from the firearm in real time, on the order of seconds. As will be appreciated by a person of ordinary skill in the art, the implementation 900 is structured around the contraption of FIGS. 6A, 6B, 6C, and FIGS. 7A and 7C through 7E, which is judiciously modified to facilitate the attachment of the implementation to and detachment of it from the firearm without requiring a removal of the guard pin.

Specifically, FIG. 9A shows in top view a portion of the embodiment 900, in which the rigid bar 902 (shown partially, with the prong 904) is affixed to a clip portion 910. The clip portion 910 is configured, in operation, to be snapped onto a firearm 810 and, in one case, onto a portion 912 of the trigger guard. By analogy with the embodiment 250 of FIG. 2E, portion I of the 902 includes an opening 902A formed by three walls. One of the three walls—the side wall 918—has an aperture 918A dimensioned to accommodate a pin of the trigger guard of a particular firearm therethrough.

The clip 910 is formed by merging together first and second parts of the clip to form a "U"-shaped portion 912. As shown in FIG. 9A, the first part of the clip is a plate member 910A having a straight portion and a bent portion defining a hook at the end of the straight portion. The second part of the clip is a plate member 910B, 910C, which plate member is extended beyond the bent portion defining a hook of the plate member 910A (such extension is indicated as 910C).

The clip is preferably but not necessarily dimensioned to provide for a spring bias between the opposing sides 910A, 910B that form the "U" of the clip. So structured, the portions 910A, 910B apply a force to the portion of the firearm onto which the clip is attached, squeezing the portion of the firearm therebetween. In the simplest case, clip 910 is made of a metal plate, a ceramic plate, or a plate made of appropriate resilient plastic material. The portion 910C of the plate member 910B, 910C contains a through hole 914 dimensioned to fit over the pin of the trigger guard (and, therefore, is dimensioned the same way as the aperture 918A is dimensioned). In one embodiment, each of the through holes or apertures 914, 918A is cylindrical (defined by a corresponding cylindrical wall). In one embodiment, the affixation of the rigid bar to the clip portion 910 is permanent, by molding or soldering. However, regardless of whether the clip portion 910 and the rigid bar 902 are attached permanently or whether the embodiment 900 can be taken apart by separating the elements 902 and 910, the cooperation between the elements 902 and 910 is such that the apertures 918A and 914 are mutually aligned to be co-axial. In a schematic diagram of FIG. 9B, the clip 910 is indicated with a dashed line and is shown not-to-scale, with the width of the plate member indicates as W.

In order to attach the secondary safety 900 to the firearm, the article 900 in positioned such that one end of the pin of the trigger guard is passed through the openings 914, 918A to position the prong 904 behind and in contact with the trigger (in a fashion discussed above) while the clip 910 grasps a portion of the firearm to ensure that the arms 910A, 910B of the "U" 912 of the clip 910 fit over and onto the opposite sides of the firearm. The detachment of the secondary safety from the firearm is done in reverse order, and also without the removal of the trigger guard pin.

Figure 9C:
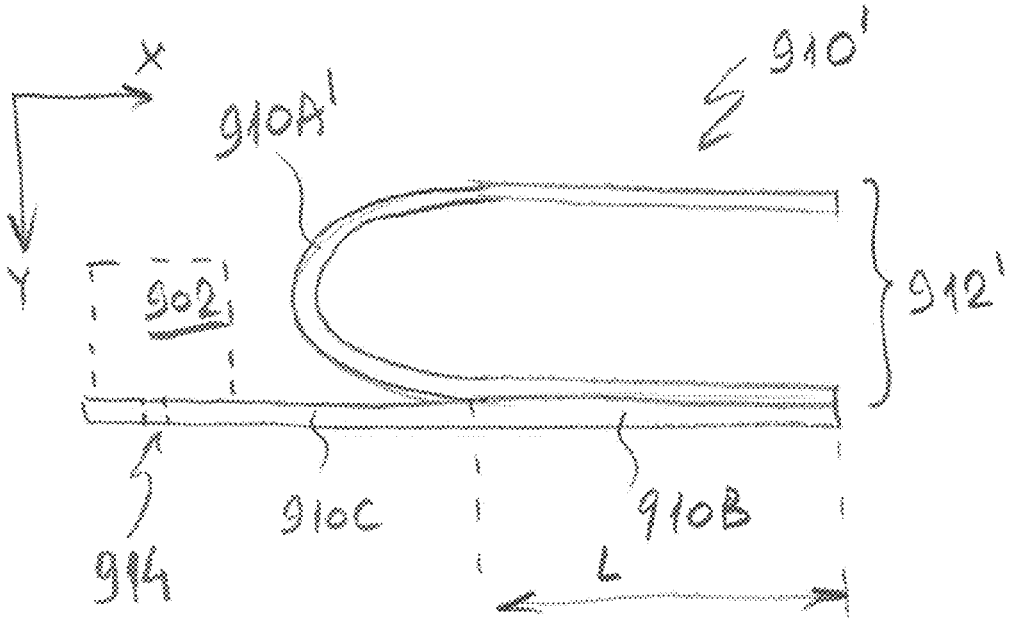
FIG. 9C is a schematic top-view diagram of another related embodiment of the secondary safety.

While constructing the clip 910 from the first and second portions each of which is structured as a plate may be preferred because it may provide a more reliable attachment of the embodiment 900 to the firearm, it is understood that in a related embodiment (not shown) the clip portion 910 can be formatted from a cylindrical rod of diameter W (and, in a specific case, from a wire) made of judiciously chosen material. In another related embodiment, the clip portion 910' for use with the rigid bar 902 can be formed from first and second parts as shown in FIG. 9C. Here, the first part shown as 910A' defines the "U" 912', while the second part is denoted as 910B, 910C. The corresponding wide surfaces (defined in the xz-plane) of the first and second parts are affixed to one another along the length L. The extension of the second part beyond the "U" 912' is labeled 910C. This extension 910C has a through hole 914 (the axis of which is parallel to the y-axis) and is attached to the rigid bar 902 (schematically indicated with a dashed line), by analogy with the case shown in FIG. 9A.

In accordance with embodiments of the present invention, method and apparatus are disclosed for configuring a secondary safety for use with a firearm, which is necessitated by the first-hand experience of the inventor and the military. Embodiments of the secondary safety are configured and intended as a back-up mechanism, an addition to the primary safety latch the activation of which may be forgotten by the user of the firearm or which becomes inadvertently disengaged. The proposed secondary safety is structured to be compatible with most of common grips of the firearms such as HOGUE or Ergo grips, for example, and provides a field-ready firearm with a passive trigger-locking mechanism operating in addition to—and independently from—the primary safety mechanism.

Therefore, embodiments of the invention provide an article of manufacture that contains a rigid bar having first and second ends (the rigid bar including first and second portions forming a spatial bend in the rigid bar, the first end corresponding to the first portion, the second end corresponding to the second portion, the spatial bend defined in a plane) and a spring mechanism affixed to the second portion in such a spatial coordination as to define, in operation of the spring mechanism, a vector of spring force in the plane. The first and second portions may be configured to form a dihedral angle in the plane. The rigid bar has inner and outer surfaces, the inner surface corresponding to an inside curvature of the bend, the outer surface being opposite to the inner surface, and the spring mechanism may include a leaf spring attached to the outer surface at only one end of the spring and disposed in the plane. In a related implementation, the rigid bar has inner and outer surfaces, the inner surface corresponding to an inside curvature of the bend, the outer surface being opposite to the inner surface, while the spring mechanism may include a coil spring attached to the outer surface at only one end of the spring. Alternatively, the spring mechanism includes a rigid plate hingedly connected to the second end and a torsion spring one end of which abuts against the second portion and another end of which abuts against the rigid plate. An article of manufacture may additionally include a firearm connected to the rigid bar with a hinge such that to position the rigid bar to define a lever pivoting about the hinge in the plane between first and second angular positions. In the first angular position i) the spring mechanism is in contact with a body of the firearm to exert a first spring force on the rigid bar; ii) the first end abuts against a back side of a trigger of the firearm at a contact point, and iii) a position of the trigger is locked by the first end due to the first spring force applied to the back side at the contact point. In the second angular position a) the spring mechanism is in contact with the body of the firearm to exert a second spring force on the rigid bar, the second spring force being larger than the first spring force; b) the first end is separated from the trigger to define a spatial gap between a tip of the trigger and an outer surface; c) the trigger is released to move from the position. In the first angular position, the contact point may be spatially separated from the tip of the trigger and the first portion may be located between the back side of the trigger and a trigger guard. A first distance defined between the second portion and the body in the first angular position may be larger than a second distance defined between the second portion and the body in the second angular position.

The present invention also encompasses a method for locking a trigger of a firearm. The steps of the method include positioning a secondary safety mechanism between a back side of the trigger and a grip of the firearm (the secondary safety mechanism including (i) a rigid bar having first and second ends, the rigid bar having first and second portions forming a spatial bend in the rigid bar, the first end corresponding to the first portion, the second end corresponding to the second portion, the spatial bend defined in a first plane, and (ii) a spring mechanism affixed to the second portion between the second portion and the body, in a spatial coordination that defines a vector of spring force in the first plane) such that the first plane is parallel to a second plane, where the second plane is defined as a plane in which the trigger moves during operation of the firearm. The steps of the method additionally include attaching the secondary safety mechanism to a body of the firearm through a hinge to form, with said secondary safety mechanism, a lever that pivots about the hinge in the first plane between first and second angular positions. The process of attaching of the secondary safety mechanism to the body may include attaching the secondary safety mechanism to the trigger guard and, in a specific case, using a removable pin of the trigger guard as the hinge.

A method may further include a step of attaching a clip portion of the secondary safety to a body of the firearm such as to grasp a portion of the body with the clip and, optionally, compress such body portion with the clip. In a specific case, the clip is fixed about a trigger guard and/or a grip of the firearm.

A method may additionally include a step of pivoting the secondary safety mechanism to the first angular position to verify that in the first angular position a) the spring mechanism is in contact with the body and exerts a first spring force on the rigid bar; b) the first end abuts against a back side of the trigger at a contact point, and c) a position of the trigger is fixed by the first end due to the first spring force applied to the back side at the contact point. Here, pivoting may include pivoting the secondary safety mechanism to the first angular position to verify that, when the secondary safety mechanism is in the first angular position and a manual safety latch of the firearm is in off position (disengaged), the trigger cannot move. Alternatively or in addition, the method may include a step of pivoting the secondary safety mechanism to the second angular position to verify that in the second angular position a) the spring mechanism is in contact with the body and exerts a second spring force on the rigid bar, the second spring force being larger than the first spring force; b) the first end is separated from the trigger to define a spatial gap between a tip of the trigger and an outer surface; and c) the trigger is released to move from the position.

References made throughout this specification to "one embodiment," "an embodiment," "a related embodiment," or similar language mean that a particular feature, structure, or characteristic described in connection with the referred to "embodiment" is included in at least one embodiment of the present invention. Thus, appearances of these phrases and terms may, but do not necessarily, refer to the same implementation. It is to be understood that no portion of disclosure, taken on its own and in possible connection with a figure, is intended to provide a complete description of all features of the invention.

It is also to be understood that no single drawing is intended to support a complete description of all features of the invention. In other words, a given drawing is generally descriptive of only some, and generally not all, features of the invention. A given drawing and an associated portion of the disclosure containing a description referencing such drawing do not, generally, contain all elements of a particular view or all features that can be presented is this view, for purposes of simplifying the given drawing and discussion, and to direct the discussion to particular elements that are featured in this drawing. A skilled artisan will recognize that the invention may possibly be practiced without one or more of the specific features, elements, components, structures, details, or characteristics, or with the use of other methods, components, materials, and so forth. Therefore, although a particular detail of an embodiment of the invention may not be necessarily shown in each and every drawing describing such embodiment, the presence of this detail in the drawing may be implied unless the context of the description requires otherwise. In other instances, well known structures, details, materials, or operations may be not shown in a given drawing or described in detail to avoid obscuring aspects of an embodiment of the invention that are being discussed.

The invention as recited in claims appended to this disclosure is intended to be assessed in light of the disclosure as a whole, including features disclosed in prior art to which reference is made.

What is claimed is:

1. A firearm article of manufacture comprising:

a firearm;

a rigid bar having first and second ends, the rigid bar including first and second portions forming a spatial bend in the rigid bar, the first end corresponding to the first portion, the second end corresponding to the second portion, the spatial bend defined in a plane, and a spring mechanism affixed to the second portion in a spatial coordination that defines, in operation of the spring mechanism, a vector of spring force in said plane, wherein the spring mechanism includes a rigid plate connected to the second end to form a first hinge, and a torsion spring one end of which abuts against the second portion and another end of which abuts against the rigid plate wherein the rigid bar is connected to the firearm with a second hinge such that the rigid bar defines a lever pivoting about said second hinge in said plane between first and second angular positions, wherein in the first angular position i) the spring mechanism is in contact with a body of the firearm to exert a first spring force on the rigid bar; ii) the first end abuts against a back side of a trigger of the firearm at a contact point, and iii) a position of the trigger is locked by said first end due to said first spring force applied to the back side at said contact point, wherein in the second angular position a) the spring mechanism is in contact with the body of the firearm to exert a second spring force on the rigid bar, the second spring force being larger than the first spring force; b) the first end is separated from the trigger to define a spatial gap between a tip of the trigger and an outer surface; c) the trigger is released to move from the position.

2. A firearm article of manufacture according to claim 1, wherein, in the first angular position, a) the contact point is spatially separated from the tip, and b) the first portion is located between the back side of the trigger and a trigger guard.

3. A firearm article of manufacture according to claim 1, wherein a first distance defined between the second portion and said body in the first angular position is larger than a second distance defined between the second portion and the body in the second angular position.

4. A method for using a firearm article of manufacture , the method comprising:

positioning said firearm article of manufacture between a back side of a trigger of a firearm and a grip of the firearm, said firearm article of manufacture including a rigid bar having first and second ends, the rigid bar having first and second portions forming a spatial bend in the rigid bar, the first end corresponding to the first portion, the second end corresponding to the second portion, the spatial bend defined in a first plane, and a spring mechanism affixed to the second portion, between the second portion and the body, in a spatial coordination that defines a vector of spring force in said first plane, wherein the spring mechanism includes a rigid plate connected to the second end to form a first hinge, and a torsion spring one end of which abuts against the second portion and another end of which abuts against the rigid plate, such that the first plane is parallel to a second plane, the second plane defined by a plane in which the trigger moves during operation of the firearm;

attaching said firearm article of manufacture to a body of the firearm through a second hinge to form, with said firearm article of manufacture, a lever pivoting about the second hinge in the first plane between first and second angular positions; and pivoting said firearm article of manufacture to the first angular position i) to bring the spring mechanism in contact with the body to exert a first spring force on the rigid bar;

ii) to abut the first end against a back side of the trigger at a contact point, and iii) to fix a position of the trigger by said first end due to said first spring force applied to the back side at said contact point.

5. A method according to claim 4, wherein the attaching includes attaching the firearm article of manufacture to the trigger guard.

6. A method according to claim 5, wherein the attaching includes using a removable pin of the trigger guard as the second hinge.

7. A method according to claim 4, wherein the pivoting includes pivoting said firearm article of manufacture to the first angular position to verify that, when said firearm article of manufacture is in the first angular position and a manual safety latch of the firearm is in off position, the trigger cannot move.

8. A method according to claim 4, further comprising pivoting said firearm article of manufacture to the second angular position a) to bring the spring mechanism in contact with the body and to exert a second spring force on the rigid bar, the second spring force being larger than the first spring force;

b) to separate the first end from the trigger to define a spatial gap between a tip of the trigger and an outer surface;

c) to release the trigger to move from the position of the trigger.

9. A firearm article of manufacture according to claim 1, wherein the rigid plate includes a protrusion and the second end includes a notch configured to receive said protrusion to define a joint formed when said protrusion is fitted within said notch.

10. A firearm article of manufacture according to claim 9, wherein said second end includes first and second openings therethrough and said protrusion includes a third opening therethrough, said first and second and third openings dimensioned to accommodate a pin on which the torsion spring is located when said first and second and third openings are coaxially aligned to affix the spring mechanism to the second end.

11. A firearm article of manufacture according to claim 1, wherein the rigid plate includes first and second protrusions to define a joint formed when the second end is fitted between the first and second protrusions.

12. A firearm article of manufacture according to claim 11, wherein said first and second protrusions include respective first and second throughout openings, the first and second openings being coaxial, and the second end includes a third opening therethrough, said first and second and third openings dimensioned to accommodate a pin on which the torsion spring is located when said first and second and third openings are coaxially aligned to affix the spring mechanism to the second end.

* * * * *